US008220906B2

(12) United States Patent
Ito

(10) Patent No.: US 8,220,906 B2
(45) Date of Patent: Jul. 17, 2012

(54) LIQUID JET HEAD, A LIQUID JET APPARATUS AND A METHOD FOR MANUFACTURING A LIQUID JET HEAD

(75) Inventor: Sukehiro Ito, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 599 days.

(21) Appl. No.: 12/354,713

(22) Filed: Jan. 15, 2009

(65) Prior Publication Data

US 2009/0185013 A1 Jul. 23, 2009

(30) Foreign Application Priority Data

Jan. 16, 2008 (JP) ..... 2008-006515
Jan. 9, 2009 (JP) ..... 2009-003243

(51) Int. Cl.
*B41J 2/045* (2006.01)

(52) U.S. Cl. ..... 347/71; 347/68; 347/18

(58) Field of Classification Search ..... 347/68–72, 347/171, 211, 18
See application file for complete search history.

(56) References Cited

U.S. PATENT DOCUMENTS

| | | | | |
|---|---|---|---|---|
| 6,386,672 | B1 * | 5/2002 | Kimura et al. | 347/18 |
| 6,736,491 | B2 * | 5/2004 | Okazawa et al. | 347/68 |
| 7,213,911 | B2 * | 5/2007 | Taira | 347/68 |
| 7,654,653 | B2 * | 2/2010 | Ito | 347/71 |
| 2007/0120887 | A1 * | 5/2007 | Yamada | 347/40 |

FOREIGN PATENT DOCUMENTS

JP 2004-074740 A 3/2004

* cited by examiner

*Primary Examiner* — Julian Huffman
*Assistant Examiner* — Sharon A Polk
(74) *Attorney, Agent, or Firm* — Kilpatrick Townsend & Stockton LLP

(57) ABSTRACT

An ink jet recording head 10 is provided which includes: piezoelectric elements 17 as a pressure generation unit that causes pressure change in pressure generation chambers 11 which are communicated with nozzle openings 13 that eject liquid; a driving circuit 60 as a driving unit that generates a driving signal for driving the pressure generation unit; a case head 20 that accommodates therein the driving unit; and a thermal conductor 35 that is in contact with the driving unit and the case head 20, in which the thermal conductor 35 and the case head 20 are fixed to each other via an thermally conductive adhesive layer 72 as a thermally conductive layer.

14 Claims, 9 Drawing Sheets

LIQUID JET HEAD, A LIQUID JET APPARATUS AND A METHOD FOR MANUFACTURING A LIQUID JET HEAD

The entire disclosure of Japanese Patent Application No. 2008-006515, filed Jan. 16, 2008 is incorporated by reference herein.

The entire disclosure of Japanese Patent Application No. 2009-003243, filed Jan. 9, 2009 is incorporated by reference herein.

BACKGROUND OF THE INVENTION

1. Field of the Invention

The present invention relates to a liquid jet head, a liquid jet apparatus, and a method for manufacturing the liquid jet head.

2. Description of the Related Art

As a typical example of a liquid jet head, for example, there is known an ink jet recording head that ejects ink droplets from nozzle openings by using pressure change caused by displacement of piezoelectric elements. Specifically, as disclosed in JP-A-2004-074740, an ink jet recording head is known which includes: a flow path unit which has a flow path forming board having therein pressure generation chambers, which are communicated with nozzle openings, and a vibration plate provided on one surface side of the flow path forming board; a nozzle plate which has the nozzle openings and is bonded to the flow path unit via an adhesive; piezoelectric elements (piezoelectric vibrators) which are arranged so as to correspond to the respective pressure generation chambers and are fixed to a support board; and a case head (a base) having therein an accommodation chamber for accommodating therein the piezoelectric elements (for example, see Patent Document 1).

A driving circuit that inputs a driving signal for driving the piezoelectric elements is mounted on a flexible printed circuit board, and the driving signal from the driving circuit is applied to the piezoelectric elements via the flexible printed circuit board.

However, the driving circuit mounted on the flexible printed circuit board is only able to dissipate heat from the driving circuit per se, the heat dissipation ability is limited. When a circuit loss exceeds the heat dissipation ability, the driving circuit may be destroyed by heat. Moreover, since a large heat dissipation area is required for securing the heat dissipation properties, there is a problem that miniaturization of the driving circuit is difficult.

Particularly, when the driving circuit is provided inside the case head as disclosed in Patent Document 1, the driving circuit is only able to dissipate heat within the case head and unable to dissipate the heat to the atmosphere, and thus the temperature of the driving circuit increases.

Such problems are similarly found in other liquid jet heads ejecting liquid other than ink as well as the ink jet recording head.

SUMMARY OF THE INVENTION

The present invention has been made in view of such circumstances, and an object of the present invention is to provide a liquid jet head and a liquid jet apparatus capable of effectively dissipating heat from a driving circuit, achieving miniaturization and low cost for the driving circuit, and improving the durability of the driving circuit, thereby improving the liquid ejection characteristics. In accordance with an aspect of the present invention, in order to solve the problems, there is provided a liquid jet head which includes:

a pressure generation unit that causes pressure change in pressure generation chambers which are communicated with nozzle openings that eject liquid; a driving unit that generates a driving signal for driving the pressure generation unit; a case head that accommodates therein the driving unit; and a thermal conductor that is in contact with the driving unit and the case head, in which the thermal conductor and the case head are fixed to each other via a thermally conductive layer.

In the above aspect, since it is possible to conduct the heat generated from the driving unit to the case head, which constitutes an exterior member, via the thermal conductor, the heat from the driving unit can be dissipated to the atmosphere via the case head. According to such a configuration, it is not only possible to prevent the driving unit from being destroyed by heat but also to achieve miniaturization of the driving unit without needing to increase the size thereof, thereby reducing the cost. Moreover, it is not only possible to prevent the life span of the driving unit from shortening by heat generation to thereby improve the durability thereof, but also to improve the liquid ejection characteristics and the continuous ejection performance.

In a preferred embodiment of the liquid jet head, the thermally conductive layer is provided at a position which opposes the driving unit. According to such a configuration, since the distance between the driving unit and the thermally conductive layer is short, it is possible to more effectively conduct the heat from the driving unit to the case head and to achieve an improvement in the heat dissipation performance of the driving unit.

In a preferred embodiment of the liquid jet head, on a surface on which the case head and the thermal conductor make contact with each other, any one of the case head and the thermal conductor is formed with ribs which are configured to project toward the other one, and the thermally conductive layer is fixed in a state where the other one makes abutting contact with distal end faces of the ribs. According to such a configuration, an improvement in the positioning accuracy for the pressure generation unit which is fixed to the thermal conductor can be achieved. Moreover, by providing the thermally conductive layer between the case head and the thermal conductor, the heat transferred to the thermal conductor from the driving unit can be effectively transferred to the case head.

In a preferred embodiment of the liquid jet head, the case head is provided with a liquid introduction path which is formed within a wall thereof to which the thermal conductor is bonded, and through which liquid is introduced to the pressure generation chambers. According to such a configuration, the case head can be additionally cooled by the liquid flowing through the liquid introduction path.

In a preferred embodiment of the liquid jet head, the thermal conductor and the case head are fixed to each other by means of an adhesive layer which has higher hardness after curing than the thermally conductive layer. According to such a configuration, the case head and the thermal conductor can be fixed to each other in a relatively short period of time by means of the adhesive layer, and an improvement in the positioning accuracy for the pressure generation unit to which the thermal conductor is fixed can be achieved. Moreover, it is possible to effectively conduct the heat transferred to the thermal conductor from the driving circuit to the case head by means of the adhesive layer.

In a preferred embodiment of the liquid jet head, the thermally conductive layer and the adhesive layer are not in contact with each other. According to such a configuration, since the thermally conductive layer and the adhesive layer do not interfere with each other, respective characteristics can be maintained.

In accordance with another aspect of the present invention, there is provided an liquid jet apparatus which includes the liquid jet head according to the above-mentioned aspect.

According to such an aspect, it is possible to realize the liquid jet apparatus which has improved reliability and can be manufactured at low cost.

In accordance with a further aspect of the present invention, in order to solve the problems, there is provided a method for manufacturing a liquid jet head, which includes: an insertion step wherein a piezoelectric element unit, which is formed by piezoelectric elements, a driving unit for driving the piezoelectric elements, a flexible printed circuit board mounting thereon the driving unit, and a thermal conductor, is inserted in an accommodation portion of a case head; a positioning step wherein a relative position of the thermal conductor to the case head is determined; an injection step wherein an adhesive for forming a thermally conductive layer is injected to any one of abutting surfaces of the thermal conductor and the case head; and a curing step wherein the adhesive is cured to fix the thermal conductor and the case head to each other.

In accordance with a still further aspect of the present invention, in order to solve the problems, there is provided a method for manufacturing a liquid jet head, which includes: an application step wherein an adhesive for forming a thermally conductive layer is applied to any one of abutting surfaces of a thermal conductor and a case head; an insertion step wherein a piezoelectric element unit, which is formed by piezoelectric elements, a driving unit for driving the piezoelectric elements, a flexible printed circuit board mounting thereon the driving unit, and the thermal conductor, is inserted in an accommodation portion of the case head; a positioning step wherein a relative position of the thermal conductor to the case head is determined; and a curing step wherein the adhesive is cured to fix the thermal conductor and the case head to each other.

I: INK JET RECORDING APPARATUS
10, 10*a*, 10*b*, 10*c*, 10*d*: INK JET RECORDING HEAD
11: PRESSURE GENERATION CHAMBER
13: NOZZLE OPENING
17: PIEZOELECTRIC ELEMENT
18: PIEZOELECTRIC ELEMENT UNIT
19: ACCOMMODATION PORTION
20: CASE HEAD
21: INK INTRODUCTION PATH
35: THERMAL CONDUCTOR
39, 39*a*, 39*b*, 39*c*: RIB
50: FLEXIBLE PRINTED CIRCUIT BOARD
60: DRIVING CIRCUIT
71: FIXING ADHESIVE LAYER
72: THERMALLY CONDUCTIVE ADHESIVE LAYER

DESCRIPTION OF THE PREFERRED EMBODIMENTS

Hereinafter, the present invention will be described in detail based on embodiments thereof

Embodiment 1

Figure 1:
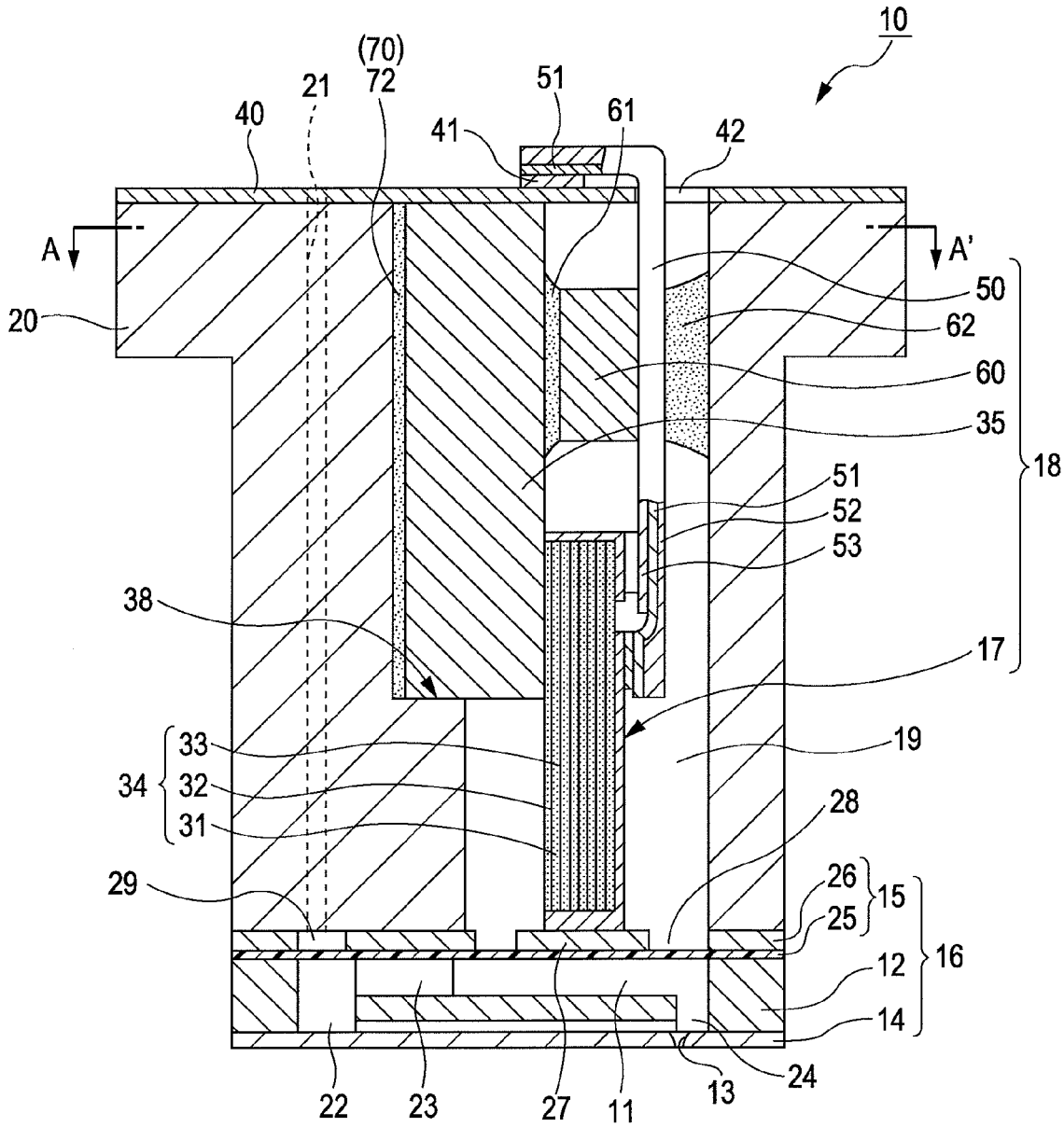
FIG. 1 is a cross-sectional view of an ink jet recording head according to a first embodiment.
Figure 2:
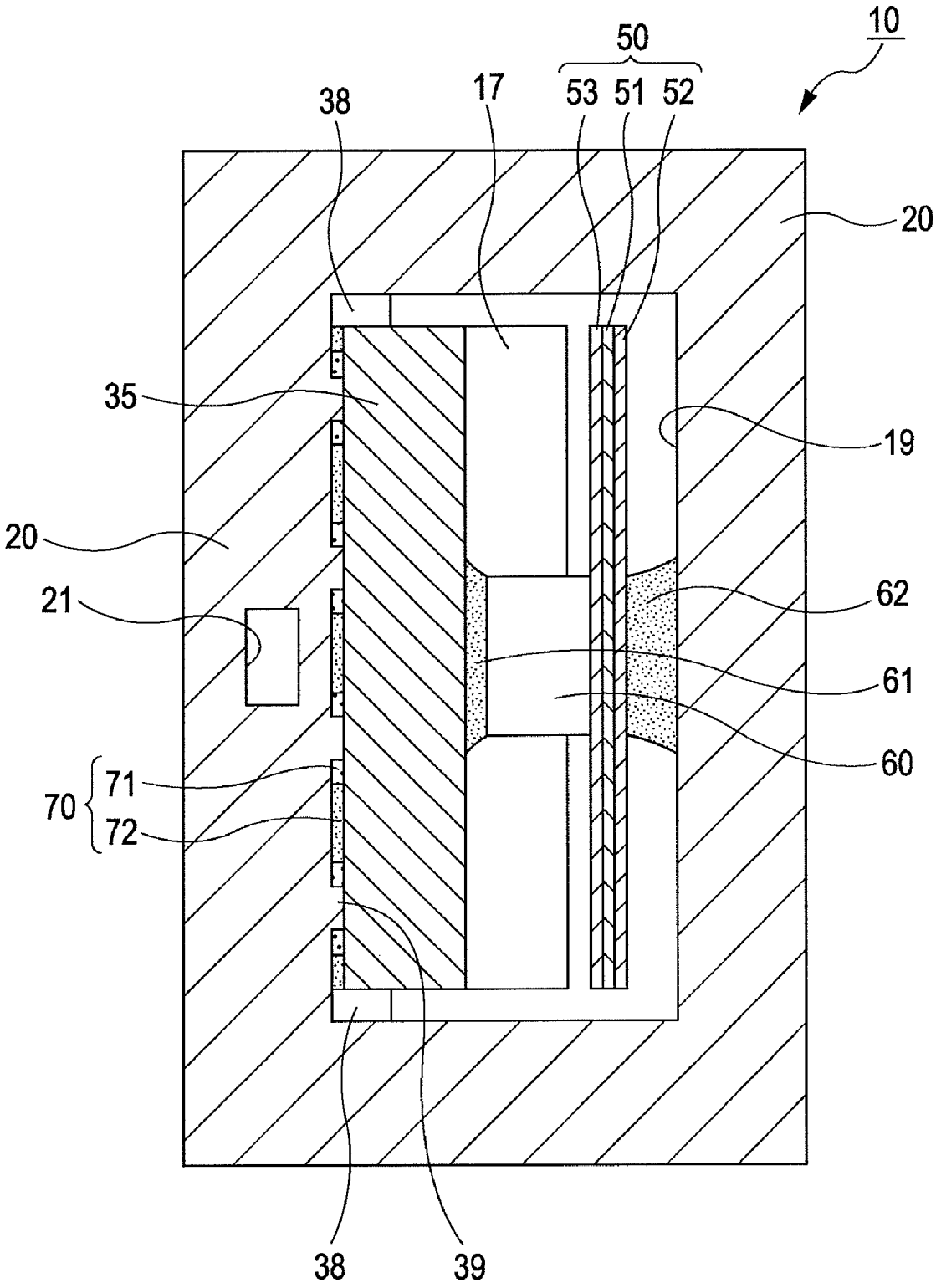
FIG. 2 is a cross-sectional view of the ink jet recording head according to the first embodiment.

FIG. 1 is a cross-sectional view of an ink jet recording head 10 which is an example of a liquid jet head according to a first embodiment of the present invention. FIG. 2 is a cross-sectional view taken along the line A-A' in FIG. 1.

As illustrated in the drawings, the ink jet recording head 10 has a flow path unit 16 which is provided with a flow path forming board 12 having therein a plurality of pressure generation chambers 11, a nozzle plate 14 in which a plurality of nozzle openings 13 is formed to be communicated with the pressure generation chambers 11, and a vibration plate 15 which is provided on a surface of the flow path forming board 12 opposite to the nozzle plate 14. Further, the ink jet recording head 10 is provided with a piezoelectric element unit 18 which has piezoelectric elements 17 provided on a region of the vibration plate 15 correspond to respective one of the pressure generation chambers 11 and a case head 20 which has an accommodation portion 19 fixed on the vibration plate 15 so as to accommodate therein the piezoelectric element unit 18.

In the flow path forming board 12, the plurality of pressure generation chambers 11 are partitioned by partition walls on a surface portion at one surface side thereof and arranged in a width direction thereof. Outside the row of the pressure generation chambers 11, a reservoir 22 to which ink is supplied through an ink introduction path 21 which is a liquid introduction path of the case head 20 is provided so as to penetrate through the flow path forming board 12 in a thickness direction thereof. The reservoir 22 and the respective pressure generation chambers 11 are communicated with each other via an ink supply path 23, so that ink is supplied to the respective pressure generation chambers 11 through the ink introduction path 21, the reservoir 22 and the ink supply path 23. In the present embodiment, the ink supply path 23 is formed with a width smaller than that of each of the pressure generation chamber 11, thereby performing a function of maintaining a constant flow path resistance for the ink introduced from the reservoir 22 to the pressure generation chambers 11. Moreover, a nozzle communication hole 24 is formed on an end portion of respective one of the pressure generation chambers 11 opposite to the reservoir 22 so as to penetrate through the flow path forming board 12. That is, in the present embodiment, as a liquid flow path, the pressure generation chambers 11, the reservoir 22, the ink supply path 23, and the nozzle communication hole 24 are provided in the flow path forming board 12. In the present embodiment, such a flow path forming board 12 is formed of a single-crystalline silicon substrate, and the pressure generation chambers 11 provided in the flow path forming board 12, and the like are formed by etching the flow path forming board 12.

The nozzle plate 14 formed with the nozzle openings 13 is bonded to the one surface side of the flow path forming board 12, and the nozzle openings 13 are communicated with the respective pressure generation chambers 11 via the nozzle communication holes 24 which are provided in the flow path forming board 12.

On the other hand, the vibration plate 15 is bonded to the other surface side of the flow path forming board 12, i.e., the opening surface side of the pressure generation chambers 11, and the pressure generation chambers 11 are sealed by the vibration plate 15.

The vibration plate 15 is formed of a composite plate which is composed of an elastic film 25 formed of an elastic member such as a resin film and a support plate 26 which is configured to support the elastic film 25 and is formed, for example, of a metal material, and the vibration plate 15 is bonded to the flow path forming board 12 at the side of the elastic film 25. For example, in the present embodiment, the elastic film 25 is formed of a PPS (polyphenylene sulfide) film having a thickness of several μm, and the support plate 26 is formed of a stainless steel plate (SUS) having a thickness of several ten μm. Moreover, within a region of the vibration plate 15 opposing respective one of the pressure generation chambers 11, an island portion 27 is provided so that a distal end portion of each of the piezoelectric elements 17 makes abutting contact therewith. A distal end face of each of the piezoelectric elements 17 is bonded to the island portion 27 by means of adhesive. That is, a small-thickness portion 28 which has a smaller thickness than other regions is formed in a region of the vibration plate 15 opposing the peripheral edge portion of respective one of the pressure generation chambers 11, and the island portion 27 is provided at the inner side than the small-thickness portion 28. Further, in the present embodiment, similar to the small-thickness portion 28, a compliance portion 29 which is substantially formed only of an elastic film because of removal of the support plate 26 by etching is provided in the region of the vibration plate 15 opposing the reservoir 22. Here, the compliance portion 29 performs a function of absorbing pressure change in response to deformation of the elastic film 25 of the compliance portion 29 when pressure in the reservoir 22 is changed to thereby maintain the pressure in the reservoir 22 always constant.

Now, the piezoelectric elements 17, as a pressure generation unit, that generate pressure for ejecting ink droplets in the pressure generation chambers 11 will be described. In the present embodiment, the piezoelectric elements 17 are formed to be integral in one piezoelectric element unit 18. That is, a piezoelectric material 31 and electrode forming materials 32 and 33 are longitudinally alternately stacked in a sandwich manner to form a piezoelectric element forming member 34, and the piezoelectric element forming member 34 is divided in a comb-teeth shape so as to correspond to respective one of the pressure generation chambers 11, whereby the respective piezoelectric elements 17 are formed. That is, in the present embodiment, a plurality of the piezoelectric elements 17 is formed to be integral therewith. An inactive region which does not contribute to vibration of the piezoelectric elements 17 (the piezoelectric element forming member 34), that is, the base end portion of the piezoelectric elements 17, is fixedly secured to a thermal conductor 35, and the piezoelectric elements 17 are fixed to the case head 20 via the thermal conductor 35. Moreover, in the vicinity of the base end portion of the piezoelectric elements 17, a flexible printed circuit board 50 having wiring layers 51, via which signals for driving the respective piezoelectric elements 17 are supplied, is connected to surfaces of the piezoelectric elements 17 opposite to the thermal conductor 35.

On the wiring layers 51 of the flexible printed circuit board 50, a driving circuit 60, as a driving unit, which is electrically connected to the piezoelectric elements 17 so as to drive the piezoelectric elements 17 is mounted. In the present embodiment, the piezoelectric element unit 18 is configured to include the piezoelectric elements 17, the driving circuit 60 as the driving unit that generates driving signals for driving the piezoelectric elements 17, the flexible printed circuit board 50 that mounts the driving circuit thereon, and the thermal conductor 35 that conducts heat generated from the driving circuit 60.

In such a piezoelectric element unit 18, the distal end portions of the piezoelectric elements 17 are fixed in a state of being in abutting contact with the island portion 27 of the vibration plate 15, as described above. For example, in the present embodiment, as described above, the case head 20 is fixed on the vibration plate 15, the piezoelectric element unit 18 is accommodated in the accommodation portion 19 of the case head 20, and the thermal conductor 35 having fixed to the piezoelectric elements 17 is fixed to a surface of the case head 20 opposite to the piezoelectric elements 17. Specifically, the case head 20 is bonded on the vibration plate 15, and the accommodation portion 19 is provided in a region which mutually opposes the island portion 27. Moreover, a step portion 38 is provided on a side of the case head 20 close to the ink introduction path 21 of the accommodation portion 19, and as illustrated in FIG. 2, the thermal conductor 35 and the case head 20 are bonded to each other in a state where the thermal conductor 35 is in abutting contact with a plurality of ribs 39 which is provided on a side face of the accommodation portion 19 close to the step portion 38.

In the present embodiment, the case head 20 and the thermal conductor 35 are bonded to each other via an adhesive layer 70 which is composed of a fixing adhesive layer 71 and a thermally conductive adhesive layer 72 as a thermally conductive layer. The fixing adhesive layer 71 is provided on both sides of the rib 39 disposed between the case head 20 and the thermal conductor 35 and between both end faces of the thermal conductor 35 located in the arrangement direction of the pressure generation chambers 11 and the case head 20. The fixing adhesive layer 71 is mainly for positioning and fixing the case head 20 and the thermal conductor 35, and can be formed, for example, using an epoxy-based adhesive having a relatively short curing time.

The thermally conductive adhesive layer 72 is provided to fill regions other than the fixing adhesive layer 71, that is, to fill voids between the thermal conductor 35 and the case head 20, which are formed by the ribs 39. Such a thermally conductive adhesive layer 72 can be formed using an adhesive having a higher heat conductivity than the fixing adhesive layer 71, for example, an adhesive having mixed therein electrothermal fillers composed of a silicon material. Since adhesives having a high heat conductivity generally require longer curing time compared with adhesives having a low heat conductivity, when the thermal conductor 35 and the case head 20 are fixedly secured to each other by means of only the adhesives (the fixing adhesive layer 71) having a high heat conductivity, the piezoelectric elements 17 may be misaligned with respect to the island portion 27. Therefore, displacement of the piezoelectric elements 17 cannot be reflected on the vibration plate 15 and it is thus highly likely to be unable to obtain good displacement characteristics and good ink ejection characteristics. On the other hand, when the thermal conductor 35 and the case head 20 are fixedly secured to each other by means of only the adhesives having relatively short curing time (the fixing adhesive layer 71), it may be unable to effectively conduct heat from the driving circuit 60, which is heat conductively connected to the thermal conductor 35, to the case head 20, detailed description of which will be provided later, whereby desired heat dissipation performance of the driving circuit 60 cannot be obtained. Of course, even when the adhesive layer 70 is composed only of the fixing adhesive layer 71 or the thermally conductive adhesive layer 72, it is possible to conduct heat from the thermal conductor 35 to the case head 20. Moreover, it is preferable that the adhesive layer 70 bonding the thermal conductor 35 and the case head 20 to each other is provided on all regions other than the distal end faces of the ribs 39 for positioning the case head 20 and the piezoelectric element unit 18. According to such a configuration, it is not only possible to firmly fix the case head 20 and the thermal conductor 35 but also to effectively conduct heat from the thermal conductor 35 to the case head 20.

The flexible printed circuit board 50 is formed of a flexible printed circuit (FPC), a tape carrier package (TCP), or the like. Specifically, the flexible printed circuit board 50 is one, for example, in which the wiring layers 51 having a predetermined pattern and formed of a copper foil or the like are formed on a surface of a base film 52 formed of polyimide or the like, and regions of the wiring layers 51 other than the regions which are connected to other wirings such as terminal portions connected to the piezoelectric elements 17 are covered with an insulating material 53 such as a resist.

Such wiring layers 51 of the flexible printed circuit board 50 are connected, at the base end portion thereof, to the electrode forming materials 32 and 33, which constitute the piezoelectric elements 17, by means of e.g., solder, anisotropic conductive material, or the like. On the other hand, at the distal end portion side thereof, the wiring layers 51 are electrically connected to conductive pads 41 of a wiring board 40 which is provided on the case head 20, detailed description of which will be provided later.

The driving circuit 60 is mounted on a region of the flexible printed circuit board 50 which mutually opposes the thermal conductor 35, and the driving circuit 60 and the thermal conductor 35 are connected to each other so that heat from the driving circuit 60 can be conducted to the thermal conductor 35. That is, the driving circuit 60 and the thermal conductor 35 are heat conductively connected (thermally bonded) to each other. Here, the heat conductively connected state (thermally bonded state) between the driving circuit 60 and the thermal conductor 35 refers to a state in which they are contacted with each other or a state in which they are bonded to each other via an adhesive or the like. That is, the driving circuit 60 and the thermal conductor 35 may be contacted with each other or may be bonded to each other via an adhesive or the like.

Further, when the driving circuit 60 and the thermal conductor 35 are heat conductively contacted with each other, a biasing mechanism such as spring or rubber for biasing the driving circuit 60 toward the thermal conductor 35 or a fixing mechanism such as a clip may be used so that the contact state is not released. Moreover, when the driving circuit 60 and the thermal conductor 35 are bonded to each other by means of an adhesive, it may be preferable to use a material having a relatively high heat conductivity as the adhesive. An example of the adhesive having a high heat conductivity includes an adhesive having mixed therein electrothermal fillers composed of a silicon material, and the like, for example. In the present embodiment, as illustrated in FIG. 1, the driving circuit 60 and the thermal conductor 35 are bonded to each other by means of a thermally conductive adhesive 61 having mixed therein electrothermal fillers. According to such a configuration, even when the ink jet recording head 10 is mounted on a carriage and moved in a main scan direction, it is possible to prevent generation of voids between the driving circuit 60 and the thermal conductor 35 due to movement of the carriage and to certainly prevent the thermal connection from being released.

Moreover, in the present embodiment, a region of the flexible printed circuit board 50 having mounted thereon the driving circuit 60, which is located on a side opposite to a surface thereof having mounted thereon the driving circuit 60 is bonded to an inner surface of the accommodation portion 19 of the case head 20 by means of a thermally conductive adhesive 62. The thermally conductive adhesive 62 is preferably formed using the same material as the above-described thermally conductive adhesive 61. In this way, by bonding the surface of the flexible printed circuit board 50 located opposite to the surface mounting thereon the driving circuit 60 to the case head 20 by means of the thermally conductive adhesive 62, it is possible to more effectively conduct heat from the driving circuit 60 to the case head 20, thereby improving the heat dissipation performance of the driving circuit 60.

An example of the driving circuit 60 includes a circuit board, a semiconductor integrated circuit (IC), and the like, for example. Moreover, the driving circuit 60 is mounted, by e.g., flip-mounting, on the wiring layers 51 of the flexible printed circuit board 50. Further, in mounting the driving circuit 60 on the flexible printed circuit board 50, metal connections, such as Au—Au connections or Au—Sn connections, ACF (anisotropic conductive paste), ACP (anisotropic conductive film), solder bump connections, and the like can be used.

As an example of the thermal conductor 35 to which the driving circuit 60 is heat conductively connected, materials having a relatively high heat conductivity, that is, materials having good heat dissipation properties are preferred, and suitable examples thereof include aluminum, copper, iron, stainless steel, and the like. Although the case head 20 is preferably formed of materials having a high heat conductivity and good heat dissipation properties, because metal materials may make the ink jet recording head 10 heavy and lead to an increase in the manufacturing cost thereof, it is preferable that the case head 20 is formed of resin material.

Moreover, as described above, the thermal conductor 35 constitutes the piezoelectric element unit 18 by being provided to be integral with the piezoelectric elements 17, and the piezoelectric element unit 18 is positioned and fixed to the case head 20 in an integrated state. At this time, the positioning of the piezoelectric elements 17 of the piezoelectric element unit 18 with respect to the vibration plate 15 (the island portion 27) is achieved by the outer circumferential surface of the thermal conductor 35 and the inner surface of the accommodation portion 19 of the case head 20. According to such a configuration, since the positioning is performed with respect to the piezoelectric element unit 18, the positioning can be carried out in an easier and highly accurate manner, compared with a case of performing the positioning by directly grasping the piezoelectric elements 17 which are brittle material. That is, the thermal conductor 35 performs not only a function of conducting heat from the driving circuit 60 to the case head 20 but also functions as a member that holds and achieves the positioning of the piezoelectric elements 17.

Furthermore, the wiring board 40 having thereon a plurality of conductive pads 41, to which the wiring layers 51 of the flexible printed circuit board 50 are connected, respectively, is fixed on the case head 20, and the accommodation portion 19 of the case head 20 is substantially blocked by the wiring board 40. On the wiring board 40, a slit-shaped opening portion 42 is formed on a region thereof which opposes the accommodation portion 19 of the case head 20, the flexible printed circuit board 50 is drawn out from the opening portion 42 of the wiring board 40 to an outside of the accommodation portion 19, and the drawn-out region is curved and connected to the conductive pads 41.

In such an ink jet recording head 10, when ink droplets are ejected, the volume of respective one of the pressure generation chambers 11 is changed in response to deformation of the piezoelectric elements 17 and the vibration plate 15 so that ink droplets are ejected from predetermined nozzle openings 13. Specifically, when ink is supplied from a non-illustrated liquid storage unit to the reservoir 22 through the ink introduction path 21 which is the liquid introduction path, the ink is distributed to the pressure generation chambers 11 through the ink supply path 23. Then, by turning on/off application of voltage to predetermined piezoelectric elements 17 in accordance with the driving signal from the driving circuit 60, the piezoelectric elements 17 are caused to be contracted or expanded, causing pressure change in respective one of the pressure generation chambers 11, whereby ink is ejected from the nozzle openings 13.

In the ink jet recording head 10 of the present embodiment, since the case head 20 and the thermal conductor 35 to which the driving circuit 60 is heat conductively connected are bonded to each other on the thermally conductive adhesive layer 72 having a high heat conductivity, the heat from the driving circuit 60 can be dissipated not only from the surface of the driving circuit 60 but also can be conducted to the case head 20 via the thermal conductor 35. That is, since the case head 20 is an exterior member which is exposed to the outside, it is possible to dissipate the heat from the driving circuit 60 to the atmosphere via the thermal conductor 35 and the case head 20. According to such a configuration, it is not only possible to prevent the driving circuit 60 from being destroyed by heat but also to achieve miniaturization of the driving circuit 60, because it is not necessary to increase the size in order to improve the heat dissipation properties of the driving circuit 60. In relation to this, because it is necessary to reduce the internal resistance of the driving circuit 60 in order to suppress heat generation in the driving circuit 60, there was necessity to secure the size for transistors in the driving circuit 60. However, since it is possible to dissipate the heat from the driving circuit 60 via the thermal conductor 35 and the case head 20 by heat conductively connecting the driving circuit 60 to the thermal conductor 35 and bonding the thermal conductor 35 and the case head 20 by means of the thermally conductive adhesive layer 72, it is not necessary to secure the size for transistors. Therefore, it is not only possible to achieve miniaturization of the driving circuit 60 but also to reduce the cost without needing to reduce the internal resistance of the driving circuit 60.

Moreover, since it is possible to suppress heat dissipation from the driving circuit 60, it is not only possible to improve the ink ejection characteristics by increasing the current supplied to the driving circuit 60, but also to improve the continuous ejection characteristics of the ink. That is, because the amount of heat generated from the driving circuit 60 increases as the current increases and the heat dissipation time decreases as the continuous ejection is performed, the current which can be flown to the driving circuit 60 or the continuous ejection characteristics of the ink may be limited. However, by allowing the heat from the driving circuit 60 to be dissipated via the case head 20 and the thermal conductor 35, it is not only possible to increase the current flowing in the driving circuit 60 but also to perform continuous ink ejection at short intervals and for a longer period of time.

Further, in the present embodiment, since the thermal conductor 35 is bonded in the vicinity of the ink introduction path 21 of the case head 20, the case head 20 can be cooled (heat-dissipated) by the ink flowing through the ink introduction path 21, whereby a further improvement in the heat dissipation properties can be achieved.

In addition, in the present embodiment, since the surface of the flexible printed circuit board 50 which is located on an opposite side to the surface having mounted thereon the driving circuit 60 is bonded to the case head 20 by means of the thermally conductive adhesive 62, it is possible to more effectively conduct the heat from the driving circuit 60 to the case head 20.

Figure 3:
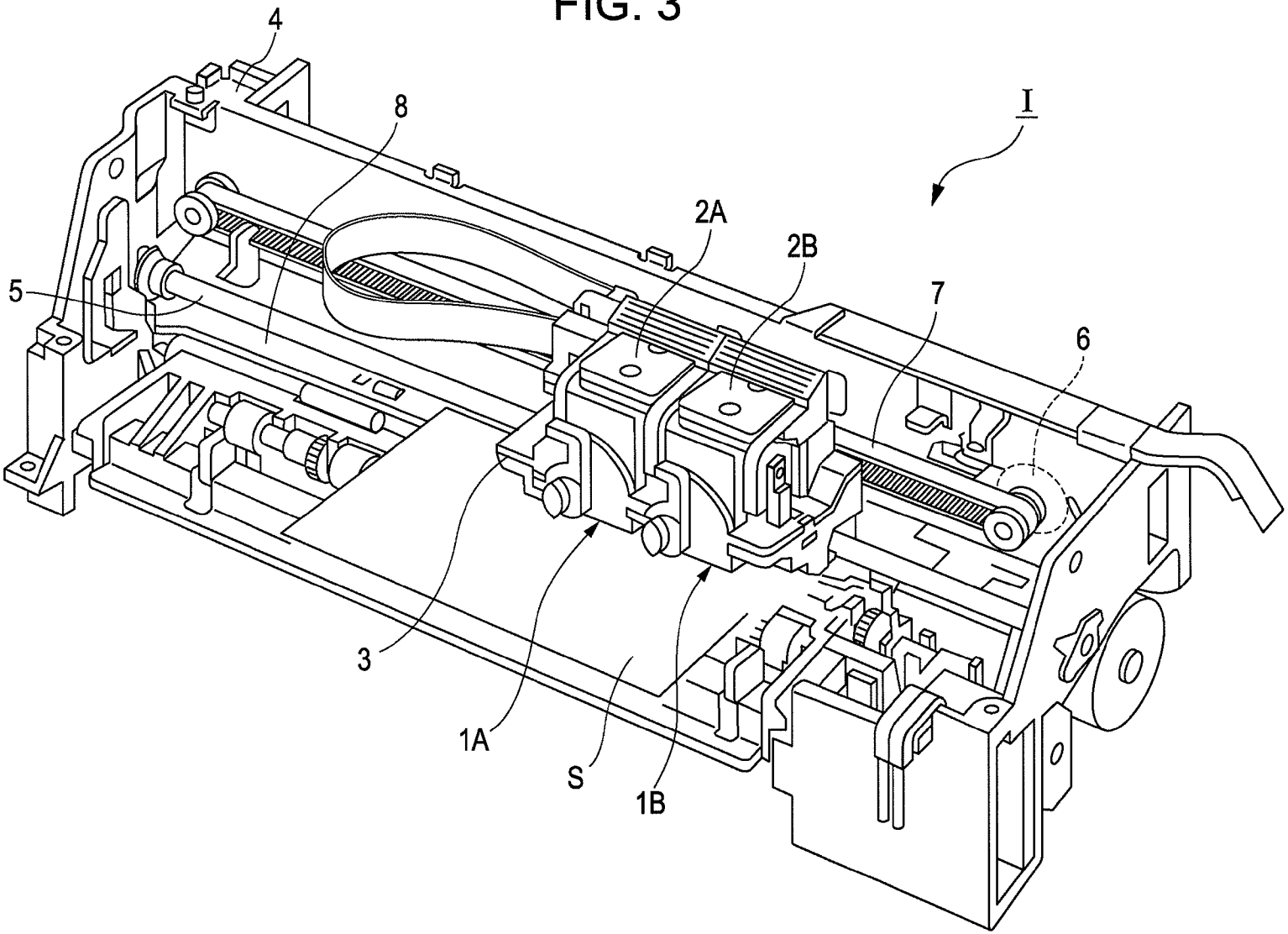
FIG. 3 is an external perspective view of an ink jet recording apparatus.

The ink jet recording head 10 according to the above-described embodiment constitutes a portion of a recording head unit which is provided with an ink flow path configured to communicate with an ink cartridge or the like and is mounted on a liquid jet apparatus. FIG. 3 is an external perspective view of an ink jet recording apparatus I illustrating an example of the liquid jet apparatus, in which a cover (not illustrated) of the ink jet recording apparatus is removed.

As illustrated in FIG. 3, recording head units 1A and 1B, which have ink jet recording heads, respectively, are provided so as to be respectively detachably attached to cartridges 2A and 2B which form an ink supply unit, and a carriage 3 mounting thereon the recording head units 1A and 1B is axially movably provided to a carriage shaft 5 which is attached to an apparatus main body 4. The recording head units 1A and 1B are configured to eject, for example, black ink composition and color ink composition, respectively.

When a driving force of a driving motor 6 is transferred to the carriage 3 via a plurality of non-illustrated gears and a timing belt 7, the carriage 3 mounting thereon the recording head units 1A and 1B is moved along the carriage shaft 5. On the other hand, a platen 8 is provided to the apparatus main body 4 along the carriage shaft 5 so that a recording sheet S which is a recording medium such as paper fed by a non-illustrated feed roller or the like is transported in a state of being wound around the platen 8.

Figure 4:
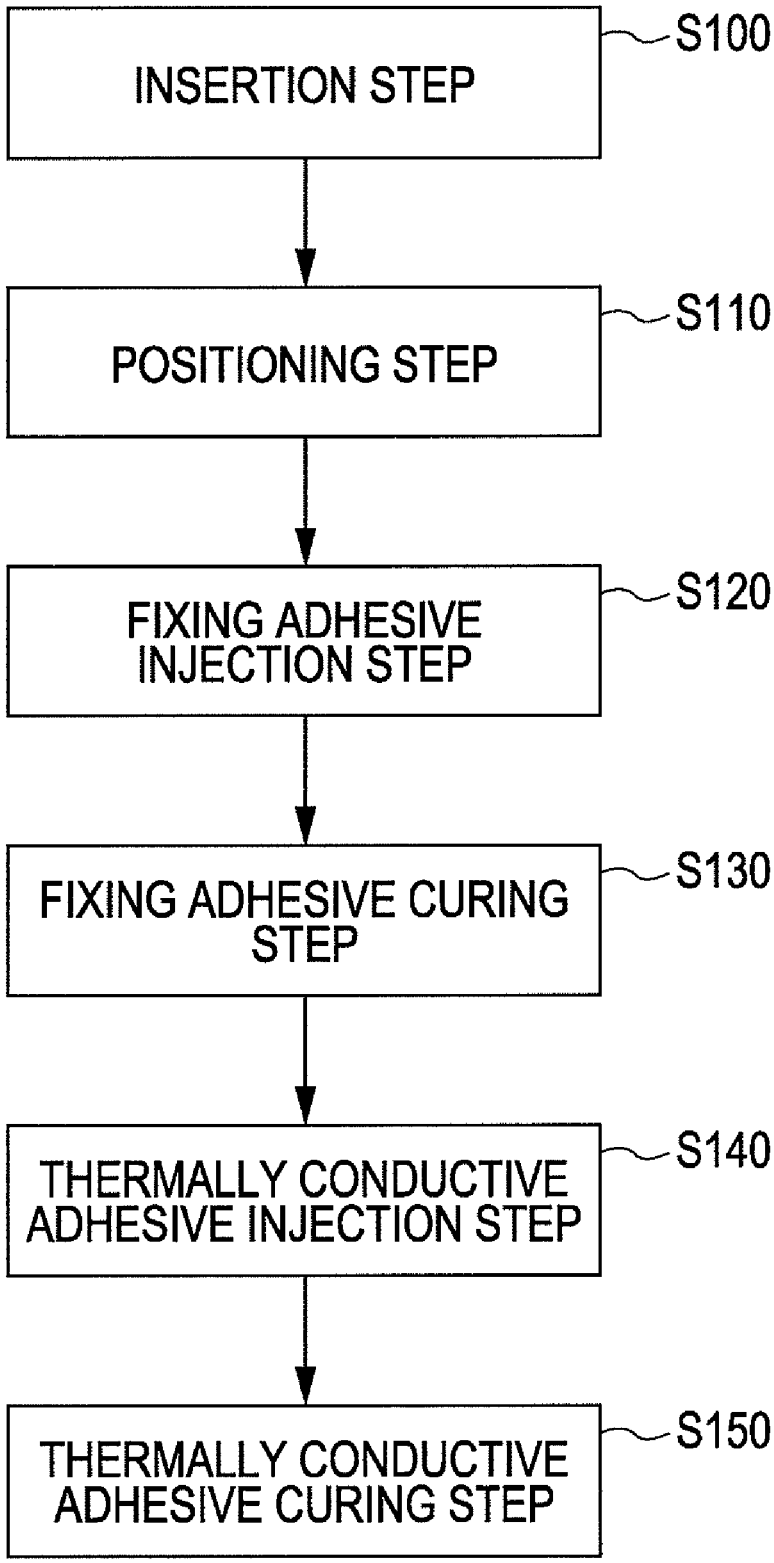
FIG. 4 is a view describing a manufacturing method for fixing a case head and a piezoelectric element unit according to the first embodiment.

Next, a manufacturing method for fixing the case head 20 and the piezoelectric element unit 18 will be described. FIG. 4 is a view describing the manufacturing method for fixing the case head 20 and the piezoelectric element unit 18 according to the present embodiment.

First, the case head 20 provided with the flow path unit 16 is prepared. At this time, the wiring board 40 and the piezoelectric element unit 18 which is formed by the thermal conductor 35, the piezoelectric elements 17, and the flexible printed circuit board 50 mounting thereon the driving circuit 60, which are illustrated in FIG. 1, are in a state of not being yet provided, and the accommodation portion 19 which is formed inside the case head 20 is a cavity.

Next, the piezoelectric element unit 18 which is formed by the thermal conductor 35, the piezoelectric elements 17, and the flexible printed circuit board 50 mounting thereon the driving circuit 60, which are illustrated in FIG. 1, is prepared. At this time, the flexible printed circuit board 50 is in a state of extending in the vertical direction of the drawing.

In insertion step S100, the piezoelectric element unit 18 provided with the thermal conductor 35 is inserted in the accommodation portion 19 of the case head 20 in the direction from the top side of the drawing toward the bottom side of the drawing of FIG. 1.

In positioning step S110, the position of the piezoelectric element unit 18 is determined so that the piezoelectric elements 17 make abutting contact with the position of the support plate 26 opposing the pressure generation chambers 11 at an opposite side to the pressure generation chambers 11. Specifically, the position thereof in the vertical direction of the drawing of FIG. 1 is determined when the lower end face in the drawing of the thermal conductor 35 makes abutting contact with the step portion 38 of the case head 20. On the other hand, the position thereof in the horizontal direction of the drawing of FIG. 1 is determined by the left side face in the drawing of the thermal conductor 35 being brought into abutting contact with the ribs 39 of the case head 20.

In fixing adhesive injection step S120, an adhesive which becomes the fixing adhesive layer 71 is injected to void regions which are formed by the thermal conductor 35 making abutting contact with the ribs 39.

In fixing adhesive curing step S130, the piezoelectric element unit 18 and the case head 20 are left at the position determined in the positioning step S110 with their postures unchanged for a predetermined period of time needed for curing the adhesive injected in the fixing adhesive injection step S120 until the piezoelectric element unit 18 and the case head 20 are fixed. At this time, a mechanism may be inserted through the opening portion on the upper side of the drawing of the accommodation portion 19 to apply a pressing force in a direction from the right to the left in the drawing.

In thermally conductive adhesive injection step S140, an adhesive which becomes the thermally conductive adhesive layer 72 is injected to void regions which are formed when the thermal conductor 35 makes abutting contact with the ribs 39.

In thermally conductive adhesive curing step S150, the piezoelectric element unit 18 and the case head 20 are left at the position determined in the positioning step S110 with their postures unchanged for a predetermined period of time needed for curing the adhesive injected in the thermally conductive adhesive injection step S140 until the piezoelectric element unit 18 and the case head 20 are fixed. At this time, a mechanism may be inserted through the opening portion on the upper side of the drawing of the accommodation portion 19 to apply a pressing force in a direction from the right to the left in the drawing.

In this way, it is possible to form the thermally conductive adhesive layer 72 in a state where the case head 20 and the thermal conductor 35 are bonded to each other by means of the fixing adhesive layer 71 which has relatively short curing time. Moreover, the positioning between the piezoelectric elements 17 and the island portion 27 can be carried out with a high accuracy, and the case head 20 and the thermal conductor 35 can be heat conductively connected to each other by means of the thermally conductive adhesive layer 72.

Next, when the upper distal end in the drawing of FIG. 1 of the flexible printed circuit board 50 is passed through the opening portion 42 provided in the wiring board 40, the wiring board 40 is provided on the case head 20. Then, the distal end of the flexible printed circuit board 50 is curved as illustrated in FIG. 1 so as to be connected to the conductive pads 41 of the wiring board 40 via the wiring layers 51.

As described above, the ink jet recording head 10 described in the present embodiment includes the piezoelectric elements 17, as the pressure generation unit, that causes pressure change in the pressure generation chambers 11 which are communicated with the nozzle openings 13 that eject liquid therefrom, the driving circuit 60, as the driving unit, that generates the driving signal for driving the piezoelectric elements 17, the case head 20 that accommodates therein the driving circuit 60, and the thermal conductor 35 that makes contact with the driving circuit 60 and the case head 20, in which the thermal conductor 35 and the case head 20 are fixed to each other by means of the thermally conductive adhesive layer 72 as the thermally conductive layer.

According to such a configuration, since it is possible to conduct the heat generated from the driving circuit 60 to the case head 20, which constitutes the exterior member, via the thermal conductor 35, the heat from the driving circuit 60 is dissipated to the atmosphere via the case head 20. In this way, it is not only possible to prevent the driving circuit 60 from being destroyed by heat but also to achieve miniaturization of the driving circuit 60 without needing to increase the size thereof, thereby reducing the cost. Moreover, it is not only possible to prevent the life span of the driving circuit 60 from shortening by heat to thereby improve the durability thereof, but also to improve the liquid ejection characteristics and the continuous ejection performance.

Moreover, it is preferable that any one of the case head 20 and the thermal conductor 35 is formed with ribs, on a surface on which the case head 20 and the thermal conductor 35 make contact with each other, so as to project toward the other one, and that the thermally conductive adhesive layer 72 as the thermally conductive layer is fixed in a state where the other one makes abutting contact with the distal end faces of the ribs. In the present embodiment, the ribs 39 configured to project toward the thermal conductor 35 are provided on the case head 20, and the thermal conductor 35 makes abutting contact with the distal end faces of the ribs 39*b*. According to such a configuration, an improvement in the positioning accuracy for the piezoelectric elements 17 which are fixed to the thermal conductor 35 can be achieved. Moreover, by providing the thermally conductive adhesive layer 72 between the case head 20 and the thermal conductor 35, the heat transferred to the thermal conductor 35 from the driving circuit 60 can be effectively transferred to the case head 20.

Furthermore, it is preferable that the case head 20 is formed with the liquid introduction path 21 for introducing liquid to the piezoelectric elements 17 on a surface thereof to which the thermal conductor 35 is bonded. According to such a configuration, the case head 20 can be additionally cooled by the liquid flowing through the liquid introduction path 21.

Furthermore, it is desirable that the thermal conductor 35 and the case head 20 are fixed to each other by means of the fixing adhesive layer 71 which has shorter curing time and higher hardness after curing than the thermally conductive adhesive layer 72 as the thermally conductive layer. According to such a configuration, the case head 20 and the thermal conductor 35 can be fixed to each other in a relatively short period of time by means of the fixing adhesive layer 71, and an improvement in the positioning accuracy for the piezoelectric elements 17 which are fixed to the thermal conductor 35 can be achieved. Moreover, it is possible to effectively conduct the heat transferred to the thermal conductor 35 from the driving circuit 60 to the case head 20 via the fixing adhesive layer 71.

Embodiment 2

Figure 5:
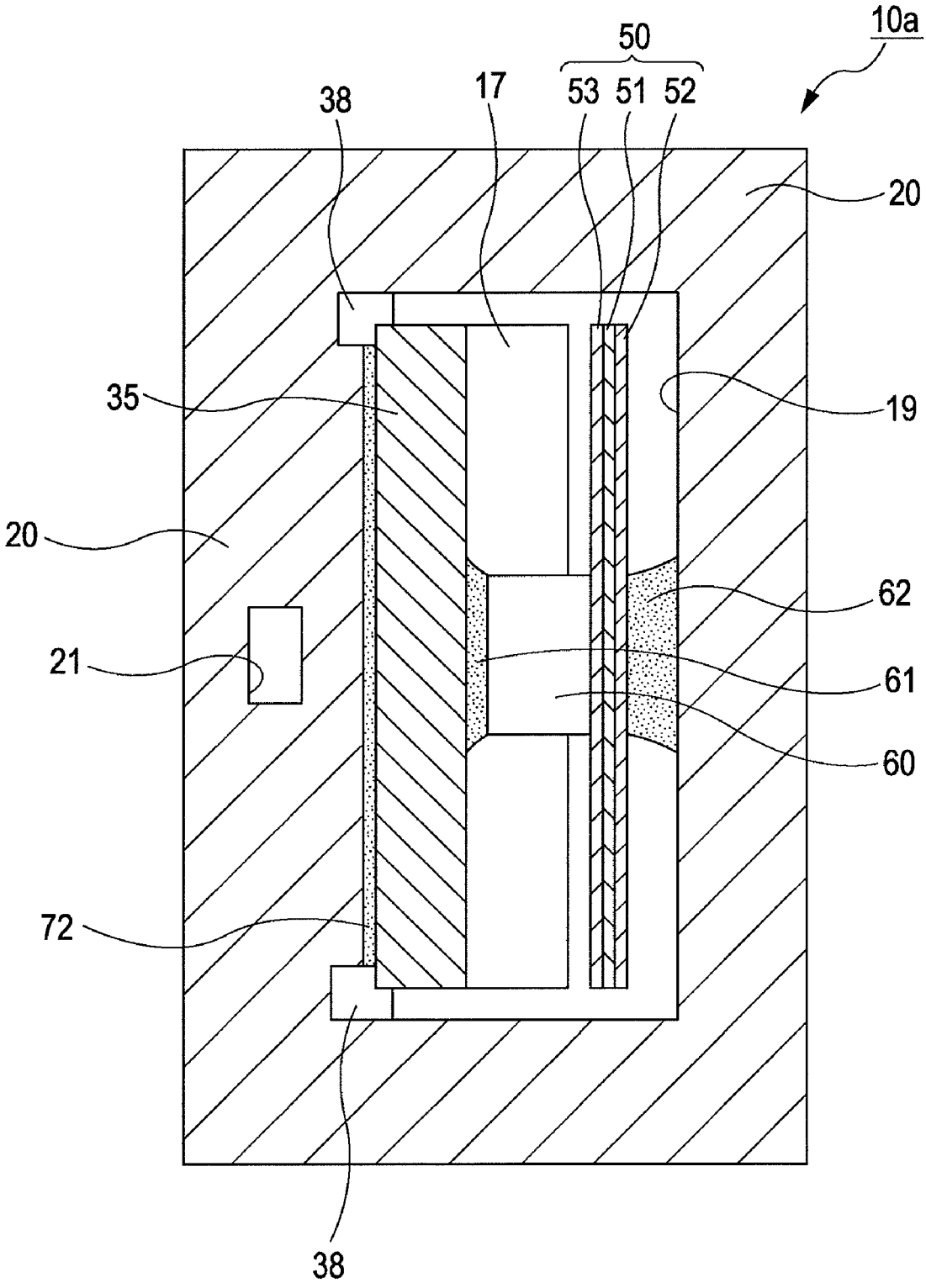
FIG. 5 is a cross-sectional view of an ink jet recording head according to a second embodiment, in which a case head and a thermal conductor are connected to each other via a thermally conductive adhesive layer as a thermally conductive adhesive layer.

FIG. 5 is a cross-sectional view of an ink jet recording head 10*a* according to this embodiment, in which the case head 20 and the thermal conductor 35 are connected to each other via the thermally conductive adhesive layer 72 as the thermally conductive layer. In the present embodiment, the thermally conductive adhesive layer 72 as the thermally conductive layer is formed over the entire surface in which the case head 20 and the thermal conductor 35 are connected to each other.

By doing so, the heat generated from the driving circuit 60 can be effectively conducted from the thermal conductor 35 to the case head 20.

Figure 6:
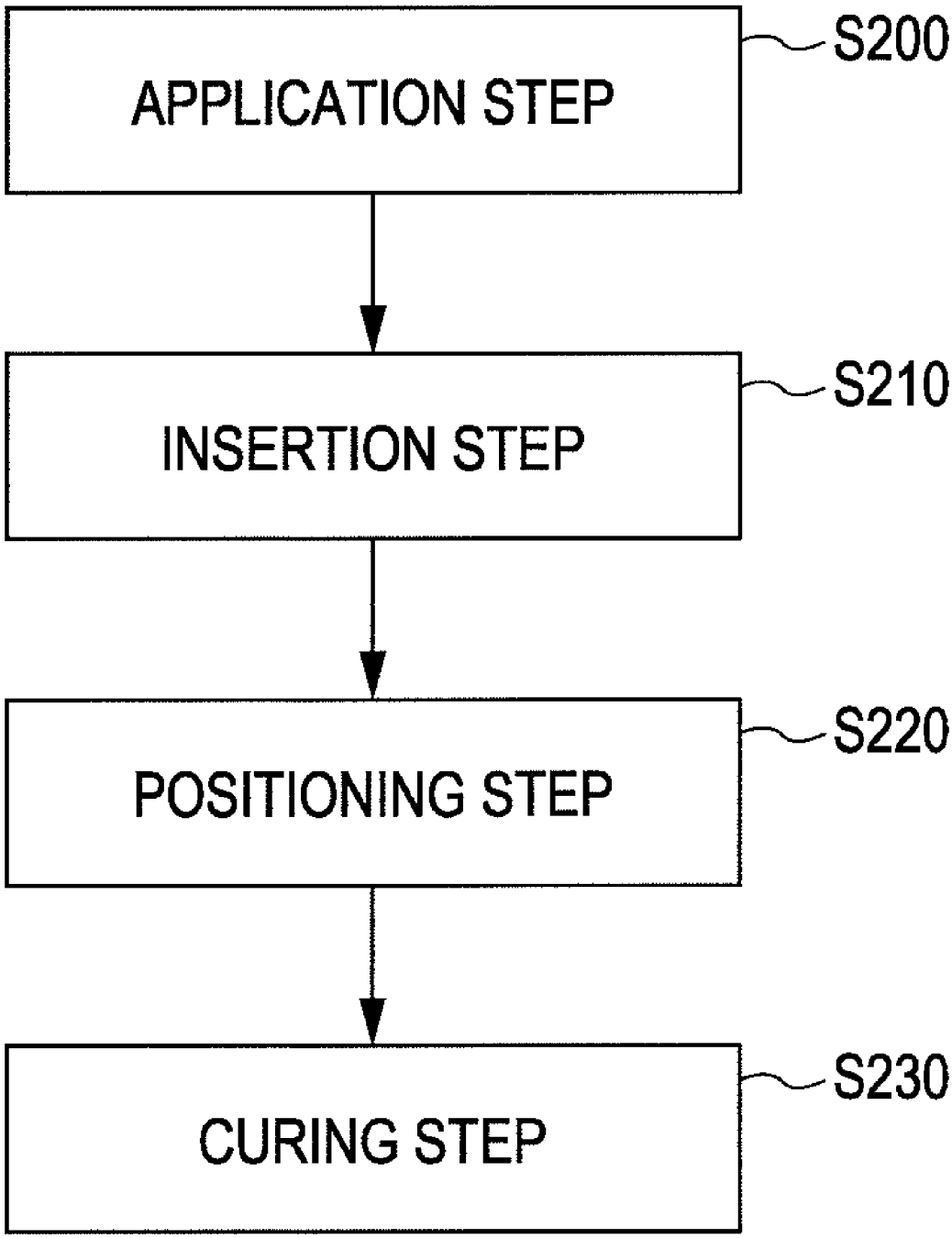
FIG. 6 is a view describing a manufacturing method for fixing the case head and the piezoelectric element unit according to the second embodiment.

Next, the manufacturing method for fixing the case head 20 and the piezoelectric element unit 18 according to the present embodiment will be described. FIG. 6 is a view describing the manufacturing method for fixing the case head 20 and the piezoelectric element unit 18 according to the present embodiment.

As described in the first embodiment, the case head 20 provided with the flow path unit 16 and the piezoelectric element unit 18, which is formed by the thermal conductor 35, the piezoelectric elements 17, and the flexible printed circuit board 50 mounting thereon the driving circuit 60, are prepared.

In application step S200, the thermally conductive adhesive layer 72 as the thermally conductive layer is applied to any one of the abutting surfaces of the thermal conductor 35 and the case head 20.

In insertion step S210, in a state where the thermal conductor 35 and the case head 20 are disposed so as to sandwich the thermally conductive adhesive layer 72 as the thermally conductive layer, the piezoelectric element unit 18 provided with the thermal conductor 35 is inserted in the accommodation portion 19 of the case head 20 in the direction from the top side of the drawing toward the bottom side of the drawing of FIG. 1.

In positioning step S220, the position of the piezoelectric element unit 18 is determined so that the piezoelectric elements 17 make abutting contact with the position of the support plate 26 opposing the pressure generation chambers 11 at an opposite side to the pressure generation chambers 11. Specifically, the position thereof in the vertical direction of the drawing of FIG. 1 is determined when the lower end face in the drawing of the thermal conductor 35 makes abutting contact with the step portion 38 of the case head 20. On the other hand, the position thereof in the horizontal direction of the drawing of FIG. 1 corresponds to a position at which the left side face in the drawing of the thermal conductor 35 is fixed to the case head 20 via the thermally conductive adhesive layer 72 having a predetermined thickness.

In curing step S230, the piezoelectric element unit 18 and the case head 20 are left at the position determined in the positioning step S220 with their postures unchanged for a predetermined period of time needed for curing the thermally conductive adhesive layer 72 until the piezoelectric element unit 18 and the case head 20 are fixed. At this time, a mechanism may be inserted through the opening portion on the upper side of the drawing of the accommodation portion 19 to apply a pressing force in a direction from the right to the left in the drawing.

Next, when the upper distal end in the drawing of FIG. 1 of the flexible printed circuit board 50 is passed through the opening portion 42 provided in the wiring board 40, the wiring board 40 is provided on the case head 20. Then, the distal end of the flexible printed circuit board 50 is curved as illustrated in FIG. 1 so as to be connected to the conductive pads 41 of the wiring board 40 via the wiring layers 51.

Embodiment 3

Figure 7:
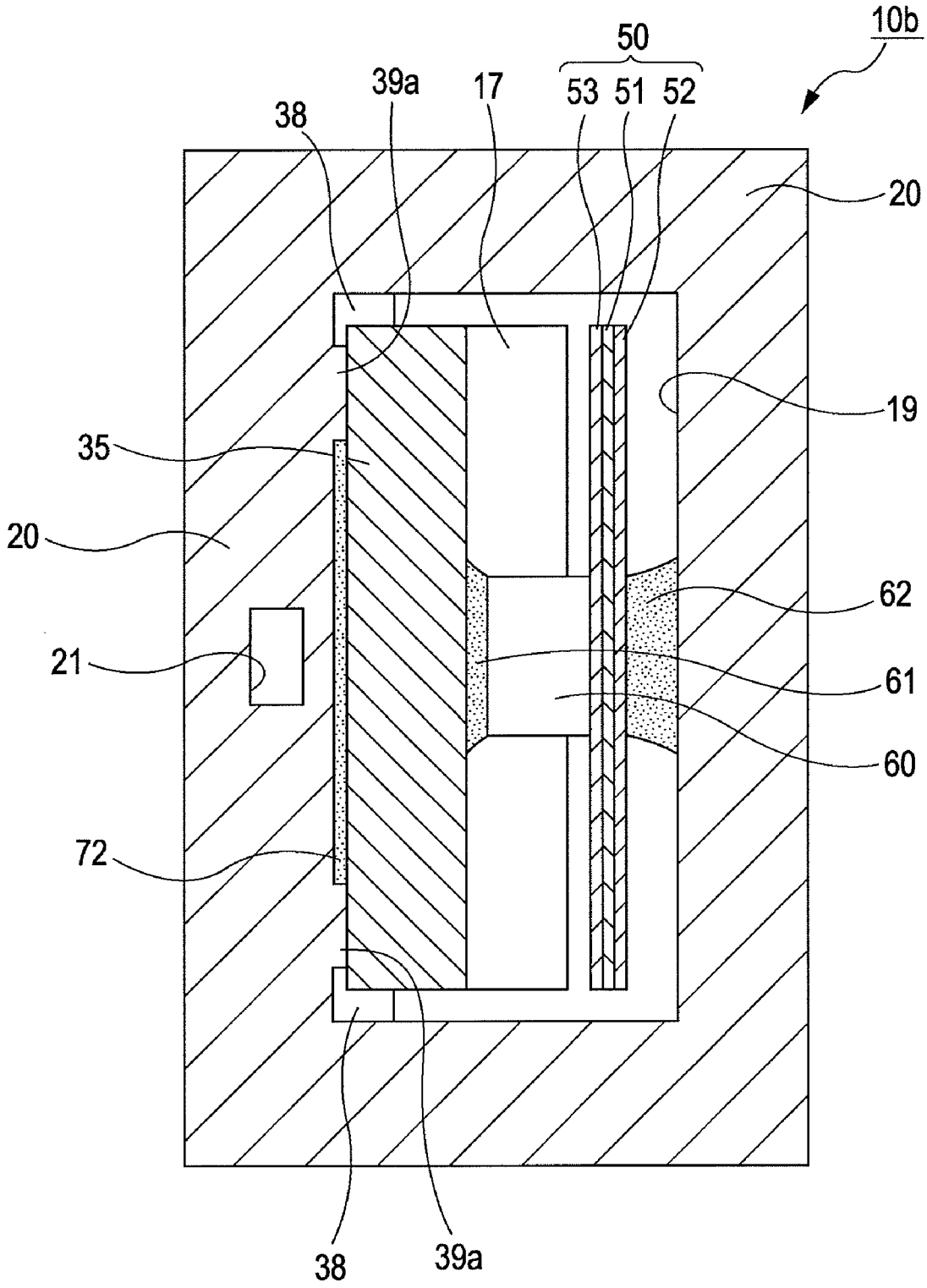
FIG. 7 is a cross-sectional view of an ink jet recording head which is provided with a thermally conductive adhesive layer at a position opposing a thermal conductor.

FIG. 7 is a cross-sectional view of an ink jet recording head 10*b* which is provided with the thermally conductive adhesive layer 72 at a position opposing the thermal conductor 35. As illustrated in FIG. 7, the case head 20 is formed with ribs 39*a* which are configured to project toward the thermal conductor 35, and the ribs 39*a* make abutting contact with the thermal conductor 35.

In the present embodiment, the thermally conductive adhesive layer 72 is formed at a position which is located in a region sandwiched by the two ribs 39*a* formed above and below in the drawing, respectively, and to which the driving circuit 60 is opposed with the thermal conductor 35 disposed between them. By doing so, the heat generated from the driving circuit 60 can be effectively conducted from the thermal conductor 35 to the case head 20.

Embodiment 4

Figure 8:
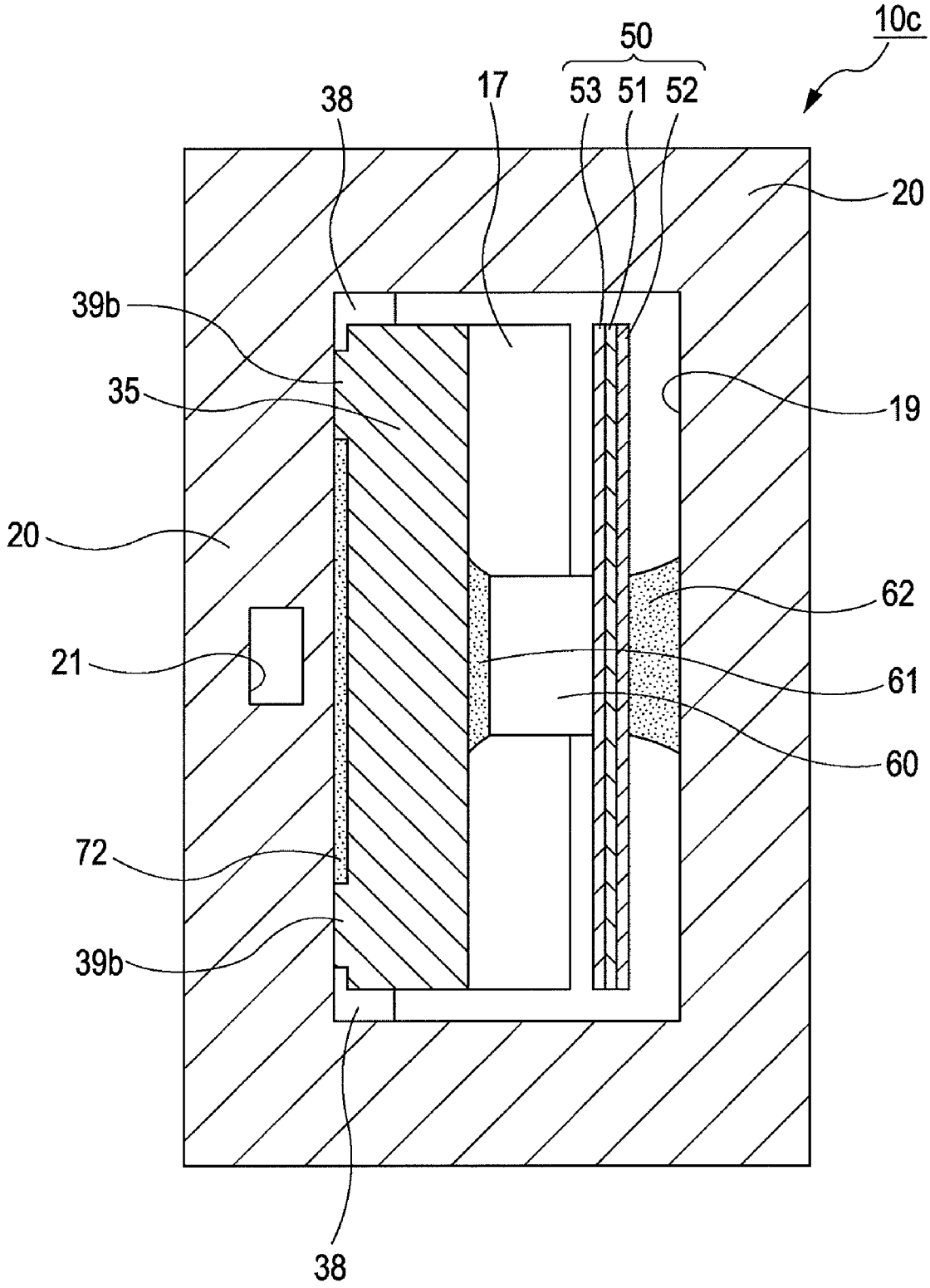
FIG. 8 is a cross-sectional view of an ink jet recording head which is provided with ribs which are formed on a surface of a thermal conductor with which a case head makes contact and which are configured to project toward the case head.

FIG. 8 is a cross-sectional view of an ink jet recording head 10*c* which is provided with ribs 39*b* which is formed on a surface of the thermal conductor 35 making contact with the case head 20 so as to project toward the case head 20. As illustrated in FIG. 8, it is preferable that any one of the case head 20 and the thermal conductor 35 is formed with ribs, on a surface on which the case head 20 and the thermal conductor 35 make contact with each other, so as to project toward the other one, and that the thermally conductive adhesive layer 72 as the thermally conductive layer is fixed in a state where the other one makes abutting contact with the distal end faces of the ribs. In the present embodiment, the ribs 39*b* configured to project toward the case head 20 are provided on the thermal conductor 35, and the case head 20 makes abutting contact with the distal end faces of the ribs 39*b*.

By doing so, an improvement in the positioning accuracy for the piezoelectric elements 17 which are fixed to the thermal conductor 35 can be achieved. Moreover, by providing the thermally conductive adhesive layer 72 between the case head 20 and the thermal conductor 35, the heat transferred to the thermal conductor 35 from the driving circuit 60 can be effectively transferred to the case head 20.

Embodiment 5

Figure 9:
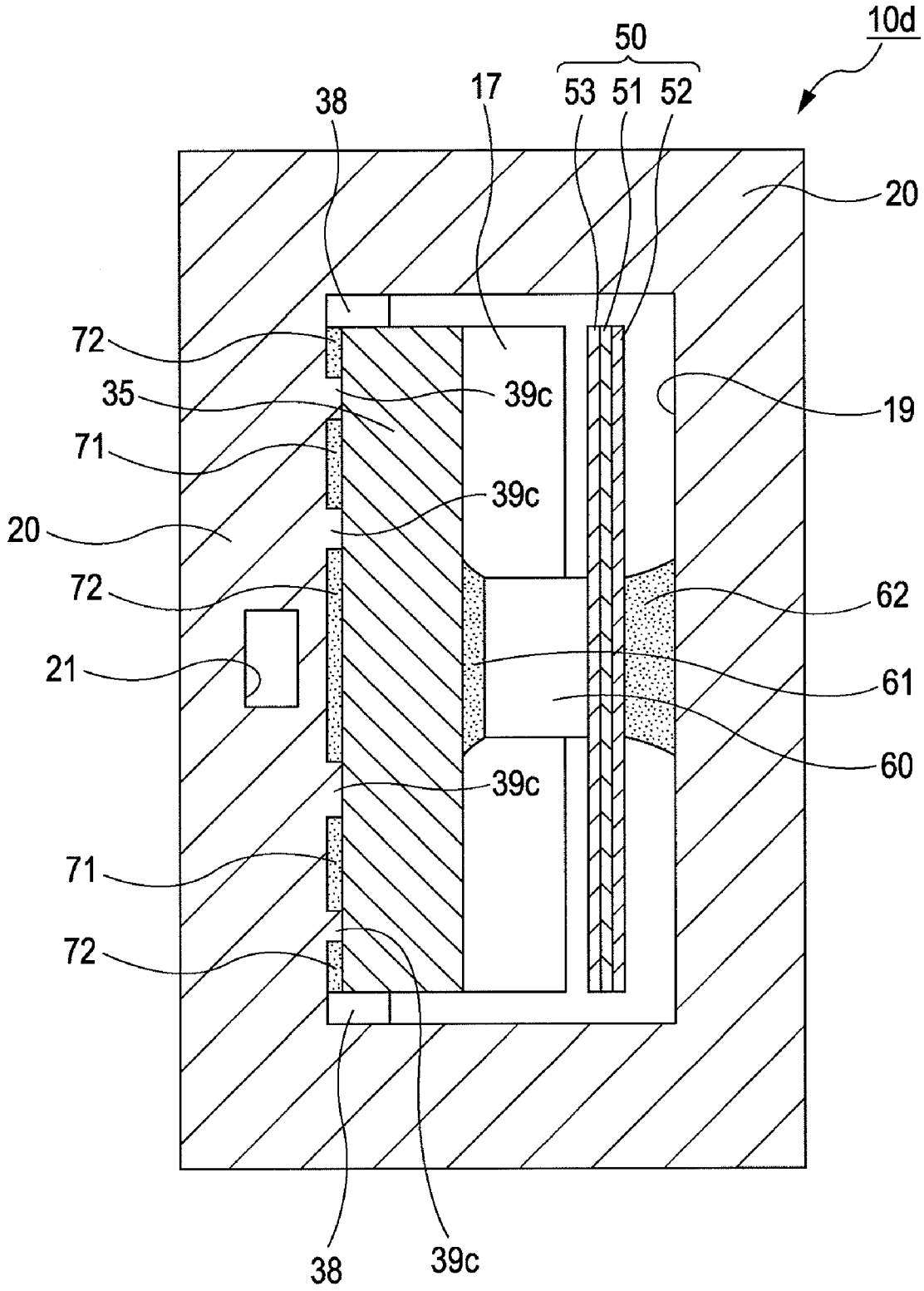
FIG. 9 is a cross-sectional view of an ink jet recording head in which a thermally conductive adhesive layer and a fixing adhesive layer are arranged so as not to make contact with each other.

FIG. 9 is a cross-sectional view of an ink jet recording head 10*d* in which the thermally conductive adhesive layer 72 and the fixing adhesive layer 72 are disposed so as not to make contact with each other. As illustrated in FIG. 9, ribs 39*c* configured to project toward the thermal conductor 35 are formed on the case head 20.

In the voids which are formed by the ribs 39*c*, the thermally conductive adhesive layer 72 or the fixing adhesive layer 72 are provided. Since the thermally conductive adhesive layer 72 and the fixing adhesive layer 72 are partitioned by the ribs 39*c* to be spaced apart from each other, they are formed discontinuously so as not to make contact with each other. According to such a configuration, since the thermally conductive adhesive layer 72 and the fixing adhesive layer 72 do not interfere with each other, respective characteristics can be maintained.

Other Embodiment

While the present invention has been described with reference to embodiments thereof, basic configuration of the present invention is not limited to the described embodiments. For example, although in the above-described first to fifth embodiments, the thermal conductor 35 is heat conductively bonded to the side of the case head 20 close to the ink introduction path 21, the region to which the thermal conductor 35 is bonded is not particularly limited to this.

Moreover, although the above-described first to fifth embodiments, the ink jet recording head has been described as the liquid jet head, the present invention is aimed to broadly cover the overall liquid jet head and is also applicable to a liquid jet head ejecting liquid other than ink. Examples of other liquid jet heads include various recording heads for use in an image recording apparatus such as a printer, a coloring-material jet head for use in manufacture of a color filter of a liquid crystal display or the like, an electrode-material jet head for use in forming an electrode of an organic EL display, an FED (field emission display) or the like, a bioorganic-material jet head for use in manufacture of a biochip, and the like.

What is claimed is:

1. A liquid jet head comprising:

a pressure generation unit that causes pressure change in pressure generation chambers which are communicated with nozzle openings that eject liquid;

a driving unit that generates a driving signal for driving the pressure generation unit;

a case head that accommodates therein the driving unit;

a thermal conductor that is in contact with the driving unit and the case head, wherein the thermal conductor and the case head make contact with each other on a contacting surface and are fixed to each other via a thermally conductive layer; and ribs located at the contacting surface on at least a first one of the case head and the thermal conductor, wherein the ribs project toward a second one of the case head and the thermal conductor and the second one makes abutting contact with distal end faces of the ribs.

2. The liquid jet head according to claim 1, the thermally conductive layer is provided at a position which opposes the driving unit.

3. The liquid jet head according to claim 1, the case head is provided with a liquid introduction path which is formed within a wall thereof to which the thermal conductor is bonded, and through which liquid is introduced to the pressure generation chambers.

4. The liquid jet head according to claim 1, the thermal conductor and the case head are fixed to each other by means of an adhesive layer which requires shorter curing time than the thermally conductive layer.

5. The liquid jet head according to claim 4, the thermally conductive layer and the adhesive layer are not in contact with each other.

6. The liquid jet head according to claim 1, the thermal conductor and the case head are fixed to each other by means of an adhesive layer which has higher hardness after curing than the thermally conductive layer.

7. The liquid jet head according to claim 6, the thermally conductive layer and the adhesive layer are not in contact with each other.

8. A liquid jet apparatus comprising the liquid jet head according to claim 1.

9. The liquid jet head according to claim 1, wherein the contacting surface of the first one of the case head and the thermal conductor comprises the ribs, and further comprises troughs defined between the ribs and separated from one another by the ribs, wherein the thermally conductive layer is disposed in at least some of the troughs.

10. The liquid jet head according to claim 9, further comprising an adhesive layer disposed in at least other ones of the troughs.

11. The liquid jet head according to claim 10, wherein the thermally conductive layer and the adhesive layer are not in contact with each other, and are separated from each other by the ribs.

12. The liquid jet head according to claim 10, wherein the adhesive comprises at least one of an adhesive layer which requires shorter curing time than the thermally conductive layer and an adhesive layer which has higher hardness after curing than the thermally conductive layer.

13. A method for manufacturing a liquid jet head, comprising:

an insertion step wherein a piezoelectric element unit, which is formed by piezoelectric elements, a driving unit for driving the piezoelectric elements, a flexible printed circuit board mounting thereon the driving unit, and a thermal conductor, is inserted in an accommodation portion of a case head;

a positioning step wherein a relative position of the thermal conductor to the case head is determined, wherein the relative position is such that:

the case head and the thermal conductor make contact with each other on a contacting surface, and wherein ribs are located at the contacting surface on at least a first one of the case head and the thermal conductor, and wherein the ribs project toward a second one of the case head and the thermal conductor and the second one makes abutting contact with distal end faces of the ribs;

an injection step wherein an adhesive for forming a thermally conductive layer is injected to any one of abutting surfaces of the thermal conductor and the case head; and a curing step wherein the adhesive is cured to fix the thermal conductor and the case head to each other.

14. A method for manufacturing a liquid jet head, comprising:

an application step wherein an adhesive for forming a thermally conductive layer is applied to any one of abutting surfaces of a thermal conductor and a case head;

an insertion step wherein a piezoelectric element unit, which is formed by piezoelectric elements, a driving unit for driving the piezoelectric elements, a flexible printed circuit board mounting thereon the driving unit, and the thermal conductor, is inserted in an accommodation portion of the case head;

a positioning step wherein a relative position of the thermal conductor to the case head is determined, wherein the relative position is such that:

the case head and the thermal conductor make contact with each other on a contacting surface, and wherein ribs are located at the contacting surface on at least a first one of the case head and thermal conductor, and wherein the ribs project toward a second one of the case head and the thermal conductor and the second one makes abutting contact with distal end faces of the ribs; and a curing step wherein the adhesive is cured to fix the thermal conductor and the case head to each other.

* * * * *